US010082378B2

(12) United States Patent
Roth

(10) Patent No.: US 10,082,378 B2
(45) Date of Patent: Sep. 25, 2018

(54) SHELL CARRIER

(71) Applicant: Adam Roth, Marianna, PA (US)

(72) Inventor: Adam Roth, Marianna, PA (US)

( * ) Notice: Subject to any disclaimer, the term of this patent is extended or adjusted under 35 U.S.C. 154(b) by 338 days.

(21) Appl. No.: 14/740,608

(22) Filed: Jun. 16, 2015

(65) Prior Publication Data

US 2016/0169649 A1 Jun. 16, 2016

Related U.S. Application Data

(60) Provisional application No. 61/998,013, filed on Jun. 16, 2014.

(51) Int. Cl.
*F42B 39/00* (2006.01)
*F42B 39/02* (2006.01)
*F41C 23/22* (2006.01)

(52) U.S. Cl.
CPC ..... *F42B 39/02* (2013.01); *F41C 23/22* (2013.01)

(58) Field of Classification Search
CPC ..... F42B 39/02; F42B 39/00; F42B 39/002; F42B 39/26; F41C 23/22
USPC ..... 206/3, 317, 377, 378, 379, 375; 211/64, 211/69; 224/931
See application file for complete search history.

(56) References Cited

U.S. PATENT DOCUMENTS 2,430,370 A 2/1948 Alexander
2,777,365 A 1/1957 Musgrave
2,791,855 A 5/1957 Simmons
3,043,198 A 7/1962 Darsie et al.
3,919,800 A 11/1975 Browning
3,923,152 A * 12/1975 Minneman ..... B25H 3/003 206/3
3,984,932 A 10/1976 Morton
4,514,922 A 5/1985 Farrar et al.
4,756,110 A 7/1988 Beltron
4,862,621 A 9/1989 Kearney
5,092,621 A 3/1992 Moore
D325,952 S 5/1992 Moore
5,531,040 A 7/1996 Moore
5,736,667 A 4/1998 Munostes et al.
5,737,865 A 4/1998 Brandl et al.
5,924,613 A * 7/1999 Johnson ..... A45F 5/02 2/94
6,367,628 B2 * 4/2002 Hu ..... B25H 3/003 206/372
6,626,286 B2 * 9/2003 Boutet ..... F42B 39/00 206/3
6,742,653 B2 * 6/2004 Kao ..... A47F 5/0861 206/373
6,817,135 B1 * 11/2004 Jackson ..... F42B 39/002 206/3

(Continued)

*Primary Examiner* — Jacob K Ackun
*Assistant Examiner* — Jenine Pagan
(74) *Attorney, Agent, or Firm* — Clothier Intellectual Property

(57) ABSTRACT

Disclosed herein is a device for containing and accessing ammunition. Specifically, a shell carrier assembly is presented herein that comprises a shell carrier holder, wherein the shell carrier holder comprises a releasable connector assembly; and a shell carrier, wherein at least a portion of the shell carrier holder and at least a portion of the shell carrier are operably coupled via the releasable connector. This device allows a wearer to quickly remove the shell carrier from the shotgun, allowing a fresh detachable shell carrier to be installed.

18 Claims, 11 Drawing Sheets

(56) References Cited

U.S. PATENT DOCUMENTS

| | | | | |
|---|---|---|---|---|
| 6,898,888 | B2 | 5/2005 | Greenhut | |
| 6,912,806 | B2 | 7/2005 | Malindretes | |
| 7,331,872 | B1 * | 2/2008 | Parsons | A45F 5/02 224/195 |
| 7,941,959 | B1 | 5/2011 | Swan | |
| 8,205,758 | B2 * | 6/2012 | Shih | A47F 7/0028 206/378 |
| 8,528,245 | B2 * | 9/2013 | Chvala | F42B 39/002 224/251 |
| 8,613,157 | B2 * | 12/2013 | McCaffery | F42B 39/02 224/931 |
| 8,960,497 | B2 * | 2/2015 | Lefeber | F42B 39/26 221/197 |
| 9,144,801 | B2 * | 9/2015 | Johnson | B01L 9/06 |
| 9,733,053 | B2 * | 8/2017 | Olroyd | F42B 39/02 |
| 2014/0103083 | A1 * | 4/2014 | Sitz | F42B 39/08 224/255 |
| 2014/0124387 | A1 * | 5/2014 | Iannello | F42B 39/02 206/3 |
| 2014/0190058 | A1 * | 7/2014 | Ballard | F42B 39/26 42/90 |

* cited by examiner

SHELL CARRIER

CLAIM TO PRIORITY

This application claims benefit and priority to U.S. Provisional Application No. 61/998,013 filed Jun. 16, 2014, the disclosure of which is incorporated by reference herein in its entirety.

FIELD OF THE INVENTION

The present invention relates to a firearm accessory device. More specifically, the present invention relates to a receiver-mounted shotgun shell carrier.

BACKGROUND OF THE INVENTION

Side saddles are shell carriers that are semi-permanently attached to a receiver of a firearm to provide quick and easy access to extra ammunition, such as lethal or non-lethal munitions. These carriers are typically commercially available in configurations having four or six shell openings for receiving munitions. Because even "high-capacity" shotguns can typically only hold six to eight shells in their internal tube magazines, a wearer only has immediate access to approximately fourteen rounds of ammunition. For military and law enforcement purposes, this may not be enough, considering many firearms on the market can hold thirty rounds or more.

There are multiple ways of carrying extra shotgun shells and different types of receiver mounted shotgun shell carriers available. Some methods for carrying individual shotgun shells include attaching the ammunition to a sling or a vest, typically though the use of elastic loops. However, this can add extra weight to a wearer, causing the overall weight of the sling or vest to be unbalanced in certain areas. This arrangement also takes a wearer more time to load a shotgun because the wearer has to retrieve ammunition from these unbalanced areas. Because the side saddle is one of the fastest areas to load from in an emergency, it would be best to refill the side saddle using shells carried on a sling or vest when time and opportunity allow. This is still very time-consuming for the wearer, and the wearer may not have the time or opportunity to safely do this.

Typical rigid, receiver mounted carriers, usually made from material such as plastic or metal, can comprise a rubber (or "rubber like") material which allows for a friction retention between the material and the shotgun shells to keep them in place. However, this rubber or rubber-like material has several disadvantages. For instance, it can wear out, causing inconsistent and unreliable shell retention. Additionally, the rubber materials that are used can be affected by temperature changes, which can cause inconsistent and unreliable shell retention. Some plastic carriers are made of a softer, flexible plastic. This can cause the slots for the shells in the carrier to flex open to allow the insertion of shotgun shells, and then securely retract around the shells, thereby providing retention of the shells. The properties that allow this plastic to flex also detract from its impact strength, making it far less durable. Another disadvantage with these types of shotgun shell carriers is that once the wearer reloads the shotgun with the shells in the carrier, there are no other good options for carrying and accessing ammunition. The shell carrier is then empty.

Another type of receiver-mounted shell carrier comprises elastic and a hook-loop material. Typically, an adhesive backed section of loop material is applied to the shotgun's receiver. The shell carrier is made of elastic loops, into which the shotgun shells are received, with a hook material on one side of the carrier. The loop portion typically comprises an adhesive to adhere to the shotgun receiver. The carrier has elastic loops into which the shotgun shells are inserted, and the loops are sewn onto hook material. The shell carrier is attached to the shotgun by securing the two pieces of hook and loop material together. This is advantageous because it allows the wearer to carry multiple shell carriers on a vest or belt. After the shotgun is reloaded and the carrier mounted to the shotgun is empty, the wearer can easily tear off the elastic/hook material and install a new fully loaded carrier. This allows the wearer to have access to more ammunition on the side of the shotgun. However, this type of carrier is disadvantageous because the hook/loop material and elastic material can wear out. The adhesive backing of the loop material may deteriorate in high temperatures or it may become detached from repetitive use. If a used shell carrier is dropped in dirt or mud, the hook material could become clogged and not be properly secured to the loop material/shotgun receiver. The elastic can wear out and give inconsistent retention of the shotgun shells. In addition, the carrier could be placed on the receiver in inconsistent locations or angles, thereby causing inconsistency in the positioning of the extra ammunition.

Therefore, it would be desirable to provide a device that can address these problems with existing side saddle shotgun carriers, thereby providing an advantage for a wearer for loading and re-loading ammunition. The device described herein provides an advantage for wearers by providing an efficient and easy method of accessing ammunition while operating a firearm. A device is provided herein which allows a user to have greater speed, efficiency, and convenience, without the drawback of a "one and done" re-load device. While traditional side saddles require tools to remove them from a firearm device, the device disclosed herein provides a quick-disconnect design to allow quick removal of an empty side saddle, after the side saddle has been re-loaded. This design is beneficial because extra fully loaded side saddles can be conveniently carried on a duty belt and instantly attached to a firearm, such as a shotgun, for example, thereby enabling the shotgun to be reloaded quickly, easily, and safely.

SUMMARY OF THE DISCLOSURE

Disclosed herein is a device for containing and accessing ammunition. Specifically, a shell carrier assembly is presented herein that comprises a shell carrier holder, wherein the shell carrier holder comprises a releasable connector assembly; and a shell carrier, wherein at least a portion of the shell carrier holder and at least a portion of the shell carrier are operably coupled via the releasable connector. The carrier comprises a first surface, the holder comprises a second surface, and in the assembled state the first surface is positioned in a contacting relationship with the second surface of the holder.

DETAILED DESCRIPTION

Throughout the present teachings, any and all of the one, two, or more features and/or components disclosed or suggested herein, explicitly or implicitly, may be practiced and/or implemented in any combinations of two, three, or more thereof, whenever and wherever appropriate as understood by one of ordinary skill in the art. The various features and/or components disclosed herein are all illustrative for the underlying concepts, and thus are non-limiting to their actual descriptions. Any means for achieving substantially the same functions are considered as foreseeable alternatives and equivalents, and are thus fully described in writing and fully enabled. The various examples, illustrations, and embodiments described herein are by no means, in any degree or extent, limiting the broadest scopes of the claimed inventions presented herein or in any future applications claiming priority to the instant application. The term "proximal" means closest to the user, and the term "distal" means farther away from the user.

Figure 1:
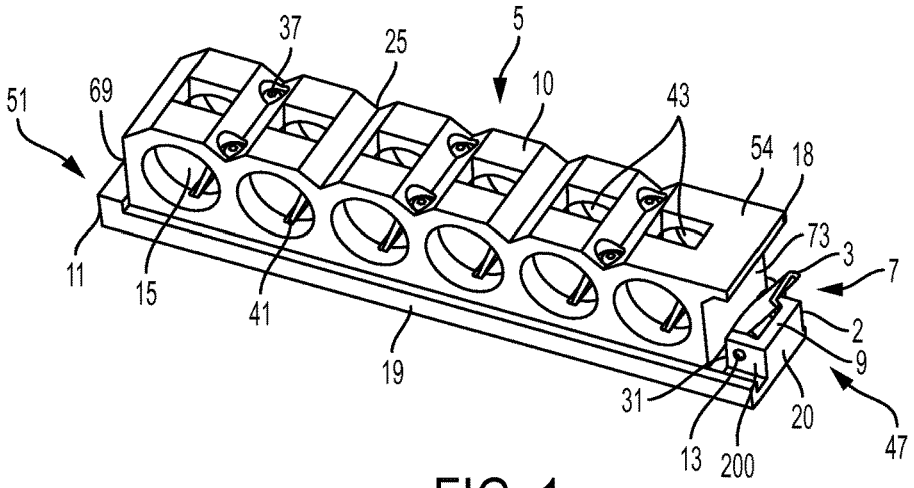
FIG. 1 is a front perspective view of a side saddle carrier assembly.
Figure 5:
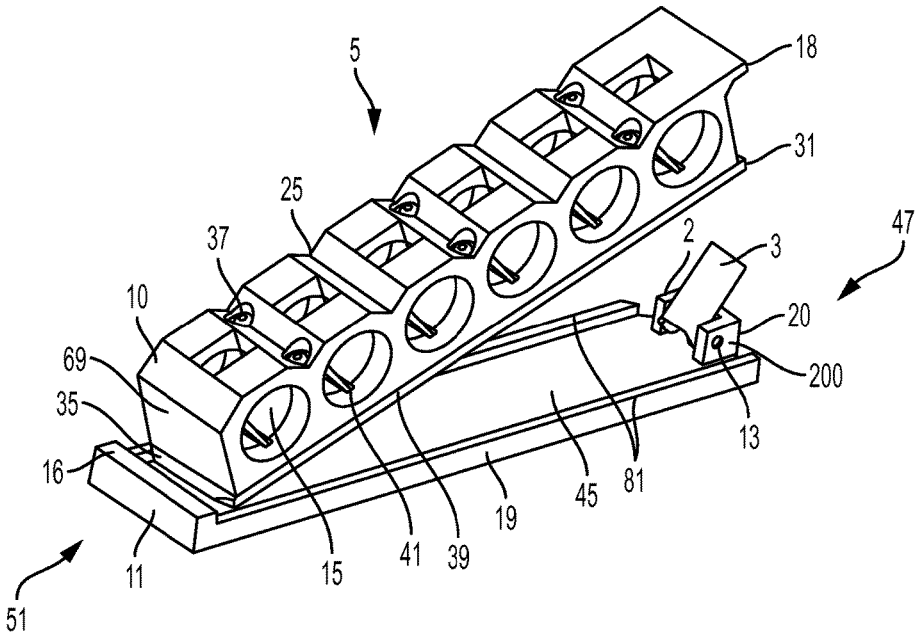
FIG. 5 is a front perspective view of the assembly of FIG. 1, in a partially disassembled state.
Figure 6:
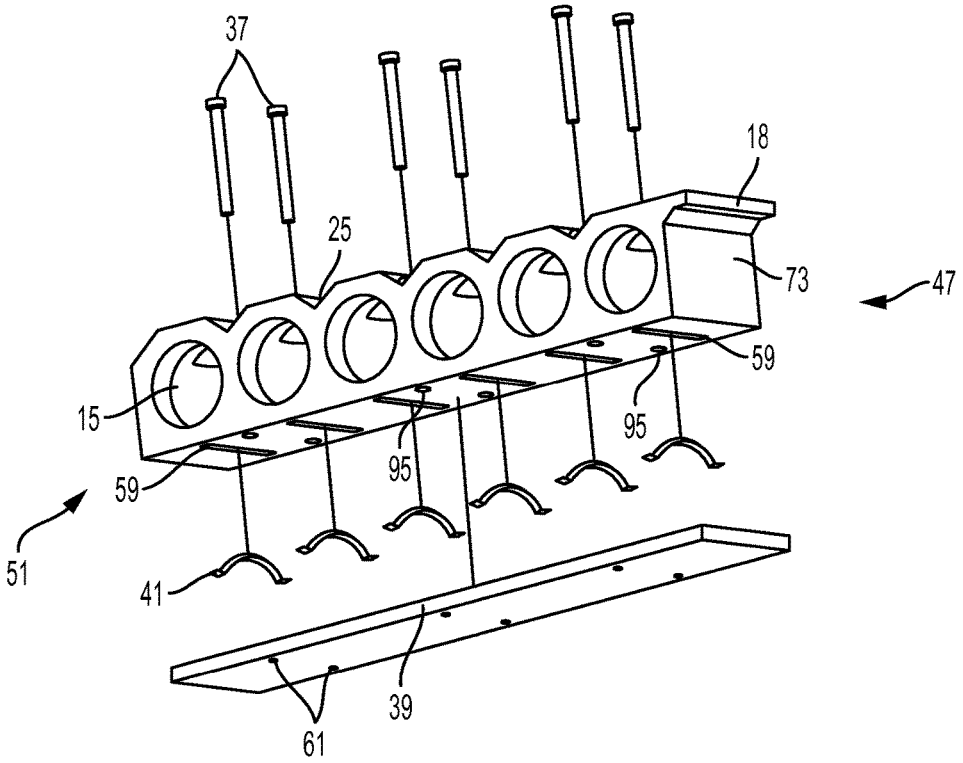
FIG. 6 is an exploded view of the shell carrier of the assembly of FIG. 1
Figure 7:
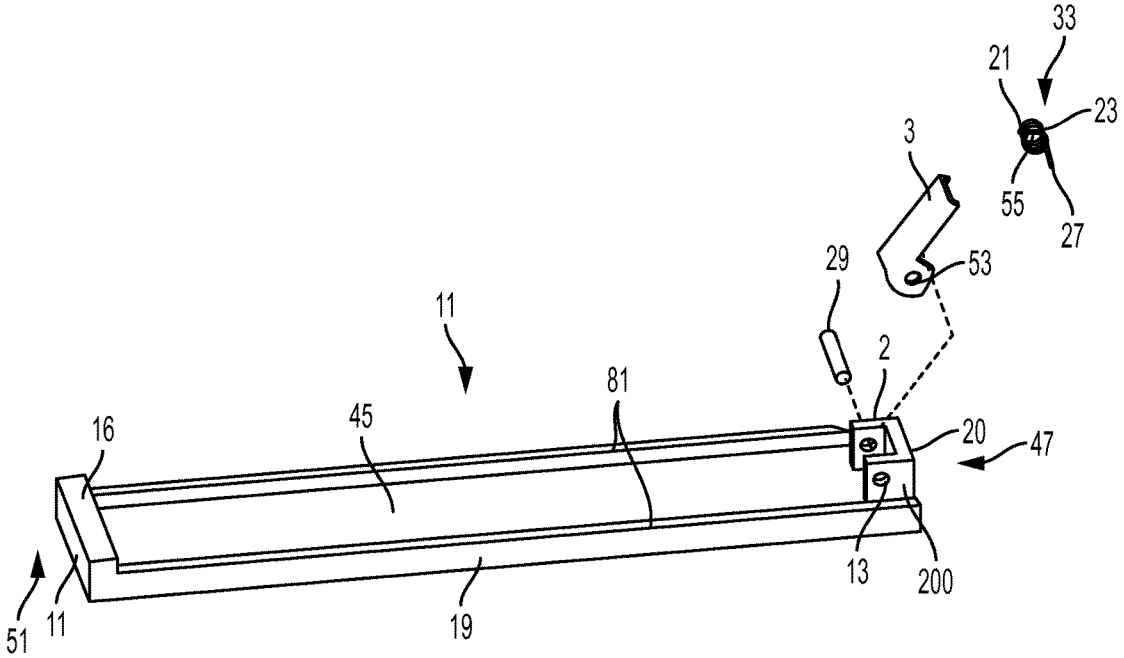
FIG. 7 is an exploded view of the shell holder of the assembly of FIG. 1.

One embodiment of the present invention is illustrated in FIGS. 1 through 7. Referring to FIG. 1, in this embodiment is illustrated a shell carrier assembly 5 comprising at least two components: a side saddle or shell carrier 10 and a side saddle mag or shell carrier holder 11. The assembly has a proximal end 47 and a distal end 51 that extend at each end of a longitudinal axis of the assembly 5. At least a portion of the shell carrier holder 11 and at least a portion of the shell carrier 10 are releasably coupled to each other via a releasable connector assembly 7. The connector assembly 7 comprises latch 3, stop portion 9, spring 33 (FIG. 7) and pin 29 (FIG. 7).

The shell carrier 10 comprises a substantially rectangular-like housing 54 having at least six outer-facing surfaces. Housing 54 may be made from plastic or aluminum or any other lightweight suitable material in order to be lighter for a wearer. However, one of skill in the art will recognize that other materials may be acceptable. The outer-facing surfaces comprise two sets of outwardly-facing opposing surfaces. Front and back surfaces 73, 69, respectively, extend substantially perpendicularly relative to the longitudinal axis of the carrier 10, and two additional opposite-facing surfaces extend longitudinally in a substantially parallel position relative to the longitudinal axis of the assembly 5. Top and bottom opposed surfaces also extend along the longitudinal axis substantially parallel to the axis. The top and bottom surfaces substantially solid, whereas outward facing opposing surfaces are defined by a plurality of openings 15.

The top surface of the housing 54 of the carrier 10 comprises a plurality of openings 43 positioned along the top of the assembly 5 in order to allow a wearer to view at least a portion of shells 14 (FIG. 3) that may be positioned within at least a portion of the housing 54 of the carrier 10. The openings 43 are spaced apart. The openings 43 can be positioned such that they can substantially parallel to each other. These openings 43 are useful because they allow a wearer to quickly and easily identify the type of shells being used. For example, the shells 14 can be identified based on their colors, patterns, or other indicia, for example. In one embodiment the housing 54 can be a solid housing. In yet another aspect, the housing 54 can be at least partially hollow, which enables the housing 54 to be light for a wearer. Although the carrier 10 is illustrated as being a substantially rectangular cuboid, the carrier 10 can also be substantially square shaped, cuboidal, cylindrically shaped, or any shape that is suitable for being attached to a body of a firearm. The housing 54 also comprises an upper lip 18 and a lower lip 31 (FIG. 4), both positioned at the proximal end 47 of the assembly 47. The overhanging upper lip 18 extends beyond the lower lip 31 and beyond the proximal face 73 toward the proximal end 47 of the assembly 5. The shell carrier 10 can be approximately 6.5 inches in length along the longitudinal axis, 1.1 inches in height, and about 1.25 inches wide.

The carrier holder 11 is capable of receiving at least a portion of the shell carrier 10. The holder 11 has a length that is longer than the length of the carrier 10 to facilitate receiving the carrier 10. Likewise, the width of the carrier 10 is smaller than the width of the shell carrier holder 11 such that the carrier 10 forms a snug fit with the carrier holder 11. The carrier holder 11 can be approximately 7.125 inches in length, about 0.125 inches to about 0.5 inches in height, and about 1.5 inches in width. In one aspect, the overall dimensions of the assembly 5 can be adapted to be compatible with any particular shotgun or other type of firearm to which the assembly 5 is coupled. The carrier holder 11 may be comprised of a plurality of different types of extruded aluminum or other materials that are welded together, such as, but not limited to, solid machined aluminum, molded plastic, or any combination of these. One of skill in the art can contemplate that other materials and methods may be used as well.

The holder 11 comprises at least one stop portion 9 at the proximal end 47 of the holder 11. The stop portion 9 can be about 0.5 inches in height. The stop portion 9 can be secured to at least a portion of the shell carrier holder 11 at the proximal end 47 of the carrier assembly 5 as a separate piece, or it can be formed, machine, molded, or extruded as part of the carrier 11. The stop portion 9 comprises at least three connected wall portions 2, 20, and 200 that together, substantially surround release latch 3. One wall portion 20 of the stop portion 9 extends along at least a portion of the width of the holder 11 such that it is parallel to the width of the shell carrier 10 and the shell holder 11. This wall 20 is joined to two walls 2, 200 that are each perpendicular to the outer wall 20 of the stop portion 9 and substantially parallel to each other. Each wall 2, 200 comprises at least one opening 13 capable of receiving at least a portion of pin 29 (FIG. 7), which is a component of releasable connector assembly 7. Stop portion 9 can be comprised of three separate wall pieces 2, 20, 200, or it can be a unitary component having three walls 2, 20, 200.

Figure 2:
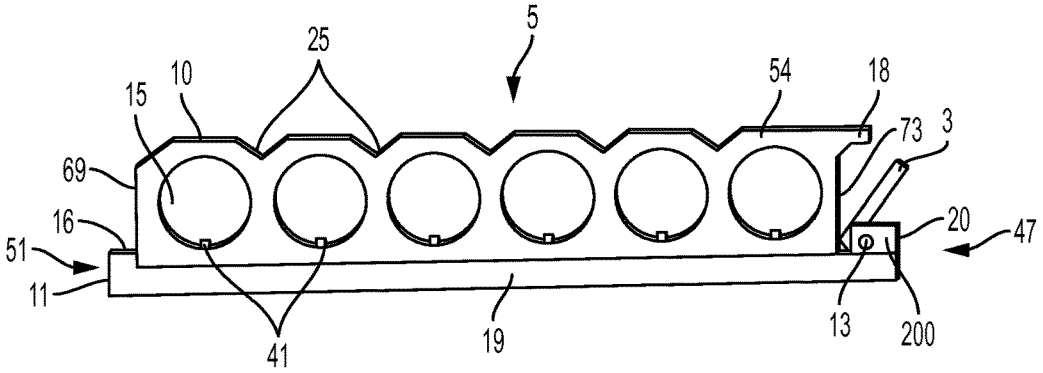
FIG. 2 is a side view of the assembly of FIG. 1.

Referring to FIG. 2, the housing 54 of the shell carrier 10 comprises at least one opening 15 capable of receiving ammunition, such as, but not limited to, shotgun shells, rifle, or pistol rounds, for example. The size of the openings 15 can be adjusted to receive ammunition of different sizes. For example, the openings 15 can be from about 0.2 inches to about 0.5 inches in diameter. The openings 15 could be adjustable openings with adjustable diameters. Such openings 15 could be resiliently displaceable, adjustably sized, and adapted to receive retention mechanisms, such as, but not limited to, bushings or spacers (not shown), for example, to allow the diameters of the openings 15 to be adjustable so that each opening 15 could be customized by a manufacturer or even a wearer to receive at least one shell. This would allow the assembly openings 15 to retain different sizes of ammunition. Other examples of resiliently displaceable retention mechanisms can include, for example, include flexible retaining arms or rings that can be mounted within in inner wall of the opening 15, such as, for example, retention strips 41, described herein.

Although the housing 54 of the carrier 10 herein is illustrated having six openings 15, in one aspect, the housing 54 can comprise any suitable number of openings 15, for example from one to ten openings. The openings 15 may be positioned next to each other in parallel positions such that they are equi-distant from each other. In other embodiments the openings 15 may be positioned such that they appear to be "stacked" or positioned in two rows, one row of openings 15 near the bottom face of the carrier 10 and one row of openings 15 near the top face of the carrier 10. The carrier 10 can be tailored to have a suitable number of openings 15, based on a wearer's preference and the size of the firearm to which the carrier assembly will be attached.

Figure 3:
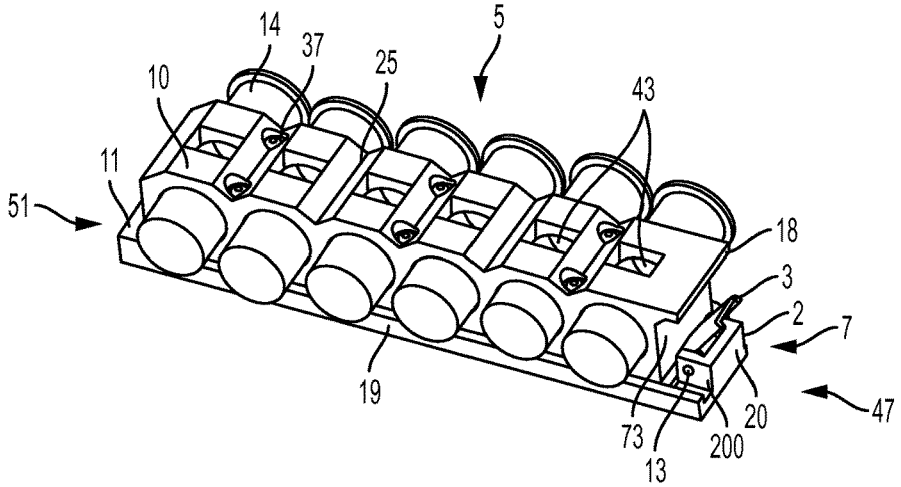
FIG. 3 is a front perspective view of the side saddle carrier assembly of FIG. 1, loaded with ammunition.

A crevice 25 is defined between each opening 43 on the upper surface of the carrier 10. In some embodiments, the crevices 25 can comprise at least one opening which is capable of receiving at least one fastening means, such as, such not limited, to a screw 37, as illustrated in FIGS. 1, 3, and 5. The screws 37 are configured to retain components of the shell carrier 10 together, including the housing 54, base plate 39 (FIG. 6), and any retention piece such as retention springs 41. The retention springs 41 extend along the width of the carrier 10 and partially extend into the openings 15 to provide a partial interference fit with at least a portion of each munition or shotgun shell 14. Other retention pieces may be used as well, such as, but not limited, to those illustrated in FIGS. 10-12 and described below.

Figure 8:
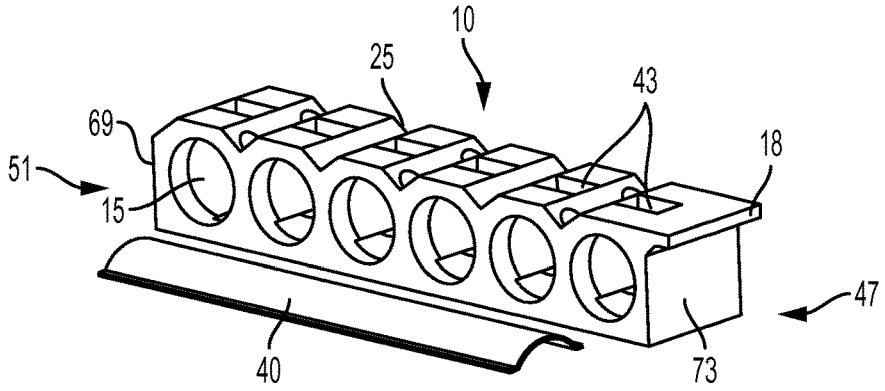
FIG. 8 is partially exploded perspective view of an alternative embodiment of a portion of the shell holder assembly of FIG. 1.

As illustrated in FIG. 3, the assembly 5 is shown in a fully loaded state. Retention springs 41 can be positioned within at least a portion of the openings 15 such that they are capable of retaining the shotgun shells 14 securely in place until a user accesses them to reload a firearm 57 (FIG. 8). In the fully loaded state shotgun shells 14 can be at least partially positioned in the openings 15 of the detachable shell carrier 10. In the fully loaded state each shell 14 can extend through the openings 15 such that the length of at least one of the shells can be wider than the width of the shell carrier 10.

Figure 4:
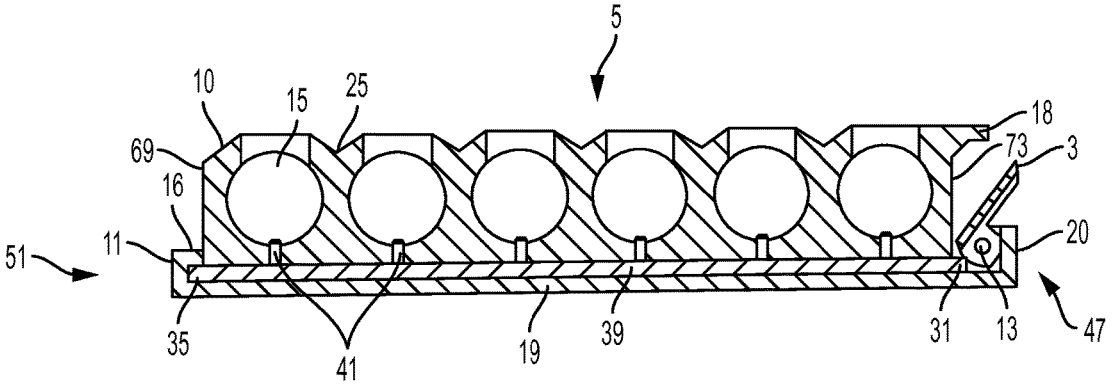
FIG. 4 is a cross sectional view of the assembly of FIG. 1.

FIG. 4 illustrates a cross-sectional view of the detachable shell carrier 10. In the assembled state, the carrier 10 is retained by shell holder 11 via a snug tongue and groove fit. The distal lip 35 of the detachable shell carrier 10 is inserted into a groove that is defined by retaining lip 16 of the shell holder 11. Proximal lip 31 of the carrier 10 is positioned such that a portion of the lip 31 is secured in place by at least a portion of the releasable latch 3, which is in a first biased state. In the assembled state, the base plate 39 of the shell carrier 10 and the receiving surface 45 of the holder 11 are in a contacting relationship from the proximal end 47 to the distal end 51 of the assembly 5.

As illustrated in FIG. 5, carrier 10 is operably coupled to the carrier holder through the latch assembly 7. When the proximal lip 31 of the detachable shell carrier 10 is positioned such that the base plate 39 of the shell carrier 10 and the receiving surface 45 of the holder 11 are in a contacting relationship from the proximal end 47 to the distal end 51 of the assembly 5, the latch 3 moves from an unbiased position to a biased position in which the actuating portion of the latch 3 extends in a proximal direction. The carrier 10 is capable of being released from the carrier holder 11 by actuating latch 3, more particularly by actuating the actuating portion of the latch 3. To release the carrier 10 from the holder 11, a user can actuate the spring-loaded actuating portion of the latch 3 by actuating, pressing, or moving the actuating portion of the latch 3 in a downward direction toward the stop portion 9 and also a proximal direction. While actuating the latch 3, the detachable shell carrier 10 can be quickly and easily removed by simultaneously manually securing the upper lip 18 of the carrier 10, and removing the detachable shell carrier 10 away from the shell carrier holder 11. When the carrier 10 is released and separated from the carrier holder 11, latch 3 transitions to a second unbiased state.

The upper lip 18 of the carrier 10 functions as a gripping piece for a user and allows a user to efficiently remove the detachable shell carrier 10 from the carrier holder 11. Upper lip 18 is also a shield that helps to protect the latch 3 from clothing and other gear so it is not unintentionally actuated. This design allows a user to remove an empty or used detachable shell carrier 10 and quickly replace it with a new, fully loaded detachable shell carrier 10. This can be done when a user actuates or depresses latch 3 such that the bottom portion of the actuating latch contacts the proximal lip 31 and moves the carrier 10 by exerting a force against the proximal lip 31 of the detachable shell carrier 10, thereby moving the proximal end of the carrier from the carrier holder 11. During use of a firearm, a user can use a swift motion to apply pressure to the latch 3 of against the proximal lip 31 of the detachable shell carrier 10, thereby dislodging and removing the used, detachable shell carrier 10 in order to replace it with a fully loaded shell carrier 10.

Referring to FIG. 6, an exploded view of the detachable shell carrier 10 is illustrated. In this view the retention springs 41 can be seen in greater detail. In an unassembled state, the retention springs 41 are unbiased and form a substantially arched configuration defined by an anchoring foot on each end of the arch. Each retention spring 41 is compressible and displaceable. Each of the retention springs 41 is configured to allow a user to insert shotgun shells 14 into each opening 15 from either end of the openings 15. This can also be seen in FIG. 13, which illustrates the loaded assembly 5 attached to the receiver of a firearm 57, such as a rifle. Each of the retention springs 41 can be comprised of, for example, stainless steel, nickel titanium, nitinol, or other types of flexible or shape memory metals (e.g., Nitinol, TiNi, or NiTi).

The shell carrier 10 comprises a plurality of openings 59 that are positioned in the base plate 39 of the shell carrier body 54. In the assembled state, at least a portion of each retention spring 41 extends through an opening 59 such that at least a portion of each of the springs 41 are in a contacting relationship with the shotgun shells 14. The retention springs 41 are positioned between the shell carrier body 54 and the shell carrier back plate or base plate 59. The base plate 59 may be made from aluminum or plastic, though other materials could be used. Screws 37 are used to hold together the components of the shell carrier 10. These screws 37 are positioned though threaded holes in the top of the carrier housing 54. The base plate 59 comprises a plurality of threaded holes 61. In the assembled state the threaded holes in the top of the carrier housing extend through the carrier housing 54 and are sealingly mated with complementary threaded holes 61 of the base plate 39. The base plate 39 and housing 54 may each comprise between two and ten threaded complementary openings, although any number of threaded holes may be contemplated. When the base plate 59 is aligned with carrier 10 such that the base plate is positioned directly underneath the carrier 10, each of the threaded holes of the carrier 10 is aligned with each of the openings 61 in the base plate 59 to form a single opening for each screw 37. The screws 37 help to keep the retaining springs 41 at least partially secured between at least a portion of the carrier 10 and at least a portion of the base plate 39.

Shells 14 can be positioned in the openings 15 in different orientations. For example, the heads of each shell 14 can face in opposite directions from each other through the openings 15 of the detachable shell carrier 10. When shells 14 are inserted into at least a portion of the openings 15, the retention springs 41, positioned through at least a portion of openings 59, will come into contact with at least a portion of the outer surface of a shell 14. When the retention springs 41 come into contact with the shells 14, the retention springs 41 become compressed from an unbiased position to a biased or substantially biased position. In the substantially biased position, each retention spring 41 exerts a constant pressure against the outer surface of each shotgun shell 14 to secure each shell in place.

Referring to FIG. 7, an exploded view of the shell carrier holder 11 is illustrated. As described above, the side saddle holder 11 and the saddle mag or shell carrier 10 are releasably connected by a releasable connector assembly 7. The assembly 7 comprises a spring-loaded release latch 3. The latch comprises an opening or through-hole 53 that is mirrored on either side of the latch 3. Spring 33 comprises a through-hole 55, a long leg 27, and a short leg 21. In the fully assembled state, the through-holes 13, 53, and 55 of the stop portion 9, the latch 3, and the spring 33, respectively, are aligned to receive pin 29. The spring 33 and the latch 3 are rotatably positioned about the pin 29 to allow for the rotation of the latch 3. In the assembled state, the torsion spring 33 is positioned relative to the latch 3 such that the through-hole 53 of the latch 3 and the through-hole 55 of the spring 33 are aligned. The latch 3 and torsion spring 33 are positioned relative to stop portion 9 such that the through-hole 13 of the stop portion is aligned with the through-holes 53 of the latch and the through-hold 55 of the spring 33. When the latch 3, torsion spring 33, and stop portion 9 are assembled, the latch pin 29 is inserted through the latch hole 13, hole 55 of the torsion spring 33, and the hole 53 of the latch 3 to retain the latch assembly components in place.

Figure 13:
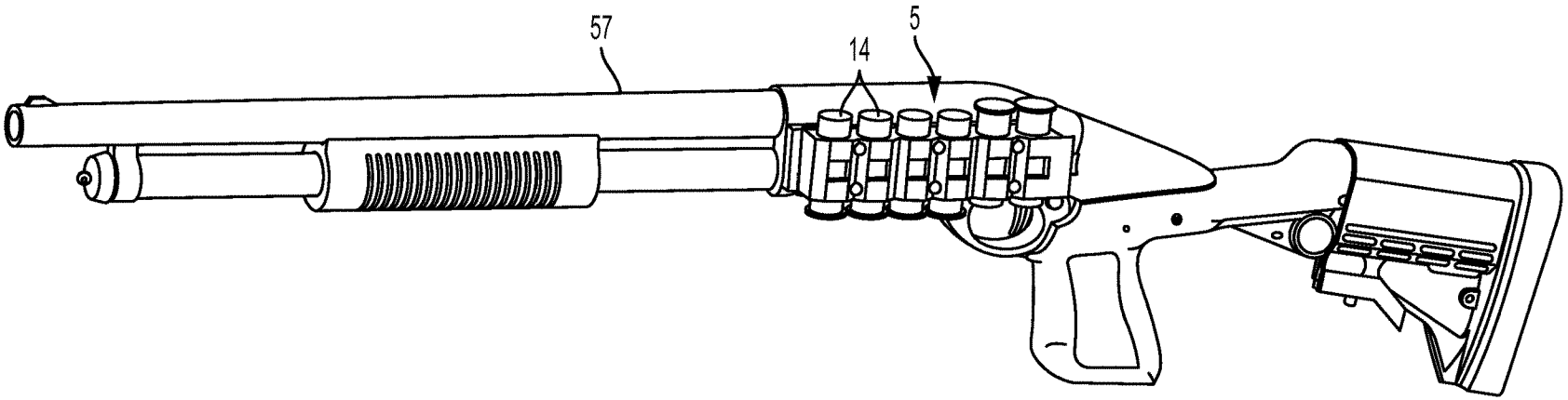
FIG. 13 is side view of the assembled side saddle carrier assembly attached to the side of a firearms device.

The release latch 3 is positioned adjacent to and is at least partially surrounded by stop portion 9. The stop portion 9 prevents the latch 3 from over-rotating. The latch 3 is capable of retaining the long leg 27 of the torsion spring 33 in place. The short leg 21 of the torsion spring 23 contacts the inside front wall of the latch 3 that faces the proximal direction of the assembly, and the long leg 27 contacts the stop portion 9. The torsion spring 33 abuts against stop portion 9, and the stop portion functions as a spring-board for the spring 33 and sustains the tension of the spring 33. The connector assembly 7 allows the shell carrier 10 to be detached from the shell carrier holder 11 upon manual actuation of the latch 3 by a user, as described above. In another embodiment, the shell carrier holder 11 can be permanently attached to the receiver of a shotgun or other type of shotgun via at least one screw or other fastener, as illustrated in FIG. 13. The carrier holder has additional features that help to keep the carrier 10 secured relative to the carrier holder 11. For example, raised edges 81 that extend along the longitudinal axis of the shell carrier holder, lip 16, and receiving surface 45 help to retain the carrier 10 in place and prevent the detachable shell carrier 10 from moving.

While FIG. 7 shows the details of one embodiment of a latch assembly 7, other methods of accomplishing a mechanical quick-detach design can be contemplated. These other methods may include, but are not limited to, a slidable retaining shelf (not shown) positioned underneath the carrier 10 to allow removal of the detachable shell carrier 10. In another embodiment, a moveable retaining pin can be positioned through the body 54 of the shell carrier 10 to hold the detachable shell carrier 10 in place. This carrier 10 may be moved by a user. Other embodiments may include any other type of latch or catch or other device or component which is capable of securing the detachable shell carrier 10 in place.

Figure 9:
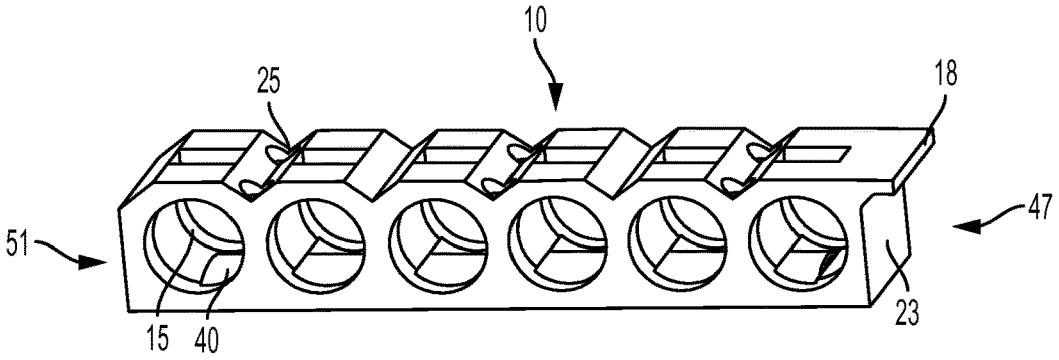
FIG. 9 is a perspective view of the shell carrier of FIG. 8, in an assembled state, comprising an alternative securement means.

As illustrated in FIGS. 8 and 9, referring again to the retention spring design, while the arched design of stainless steel retention springs 41 represent one embodiment, other shapes and types of retention springs may be acceptable as well. These other types of springs may include, but are not limited to, a single retention spring 40 positioned across the entire length of the carrier 11 to provide retention for every shotgun shell 14. The single retention spring 40 is defined as a unitary arched retention component that extends along substantially the entire length of the carrier 10. Similar to individual retention springs 41, the single retention spring 40 is positioned such that at least a portion of each shell 14 comes into contact with at least a portion of the single spring 41. FIG. 9 illustrates the carrier 10 with the retention spring 40 assembled within the carrier 10. In this configuration at least a portion of the retention spring 40 extends into at least a portion of each opening 15.

Figure 10:
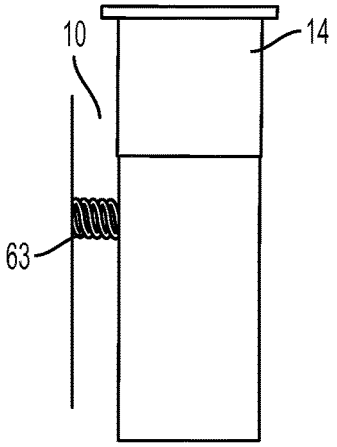
FIG. 10 is a side view of the alternative securement means of the shell carrier assembly of FIG. 9 fully assembled with the carrier device.

Referring to FIG. 10, yet another embodiment of the carrier 10 and holder 11 could comprise compression springs 63 which could be coiled and can be used for retention of the shells 14 in at least a portion of the openings 15. Such springs 63 could be made of stainless steel, nitinol, or any other suitable material.

Figure 11:
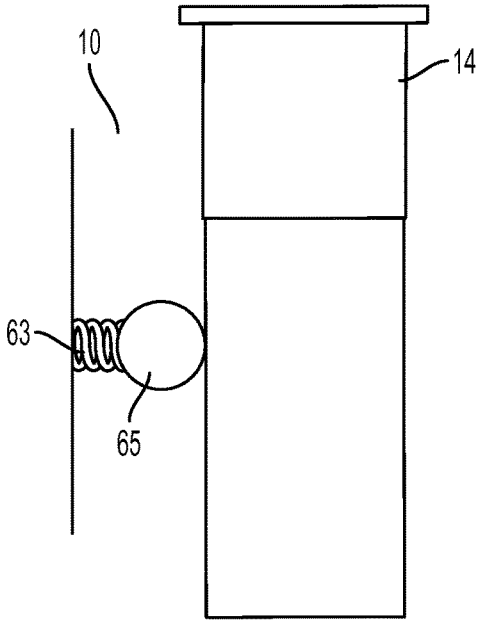
FIG. 11 is cross-sectional view of an alternative securement means of the shell carrier assembly of FIG. 1.

Referring to FIG. 11, yet another embodiment can comprise coiled springs 63 that are attached to ball bearings 65 which are positioned between the springs 63 and the shotgun shell 14. Although the springs 63 described herein can be made of stainless steel, in other embodiments, the springs 63 can be made of other types of metals described herein, plastic, composites, or other any materials.

Figure 12:
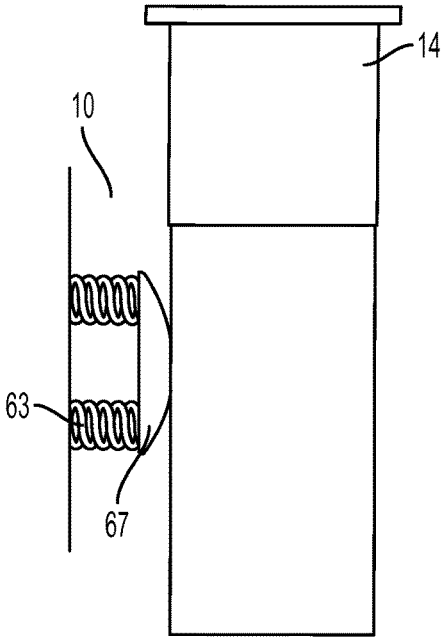
FIG. 12 is a cross-sectional view of an alternative securement means of the shell carrier assembly of FIG. 1.

Referring to FIG. 12, in yet another embodiment, the coil springs 63 could be in contact with the shell 14 via a bumper 67 which is attached to the coiled springs 63.

FIG. 13 illustrates the assembly 5 described herein attached to a firearm device 57, such as a rifle.

FIGS. 14A through 15B illustrate another embodiment of a shell carrier holder 10. This embodiment is similar to the embodiment illustrated in FIGS. 1 through 9. In these additional embodiments the carrier 10 may have a face 69 that is at least partially rounded. In another aspect, each opening 15 may comprise a reinforcement or rim 71 that substantially completely surrounds at least a portion of the opening 15.

Figure 14A:
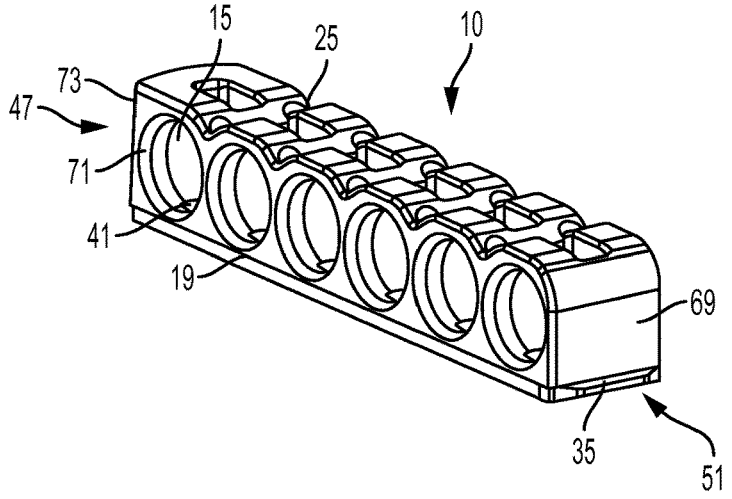
FIG. 14A is a perspective view of a different embodiment of the side saddle carrier of FIG. 1.
Figure 14B:
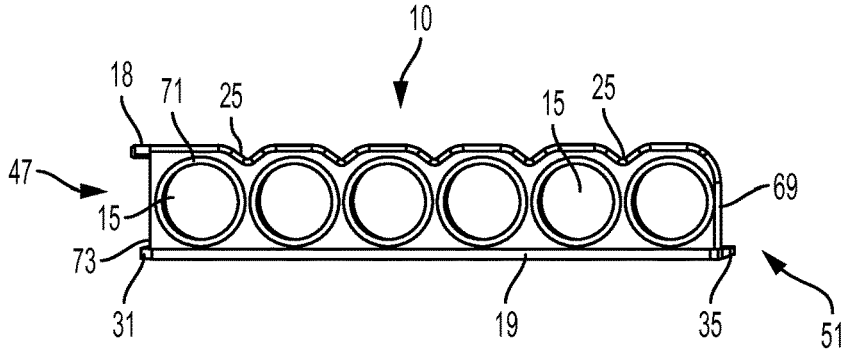
FIG. 14B is a side view of the carrier of FIG. 14A.

FIG. 14B illustrates the carrier 10 and back plate 39 having a lip 31 that is protected by overhanging lip 18 and lip 35 that is positioned toward the distal end 51 of the carrier 10.

Figure 14C:
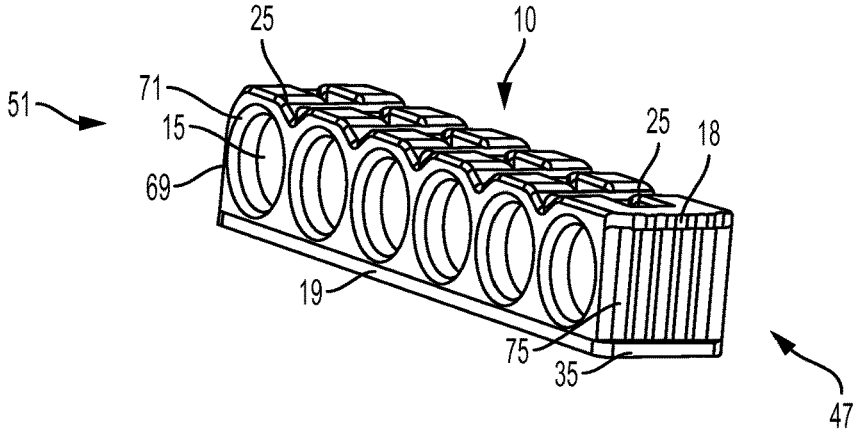
FIG. 14C is a perspective view of the carrier of FIG. 14A.

FIG. 14C illustrates in one embodiment the carrier 10 may have vertically extending ridges extending from the back plate 39 to the overhanging lip 18. The vertically extending ridges 75 may be equi-distant, or they may be spaced apart by different distances.

Figure 15A:
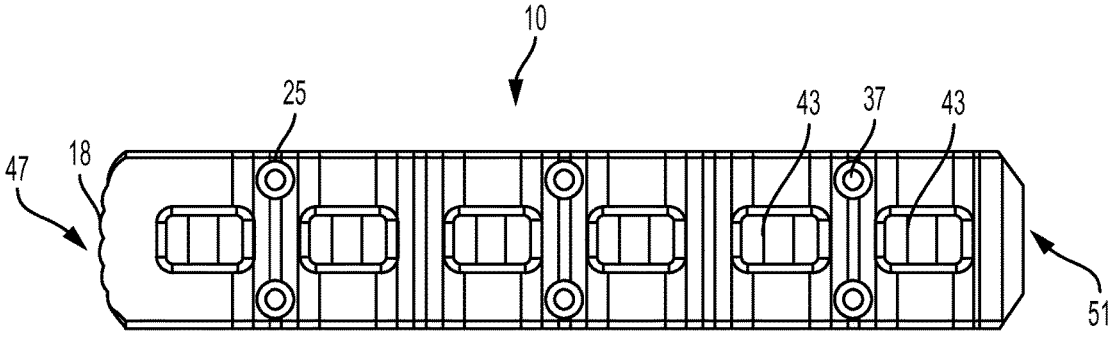
FIG. 15A is a top view of the carrier of FIG. 14A.
Figure 15B:
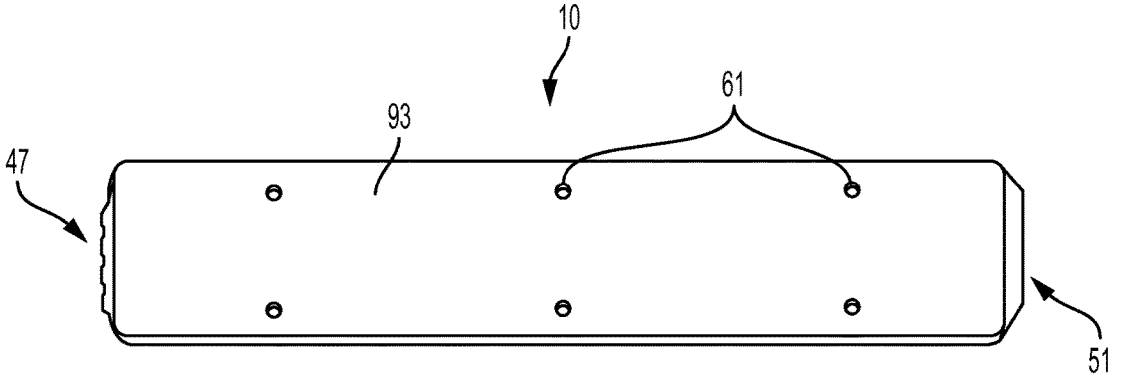
FIG. 15B is bottom view of the carrier of FIG. 14A.
Figure 16A:
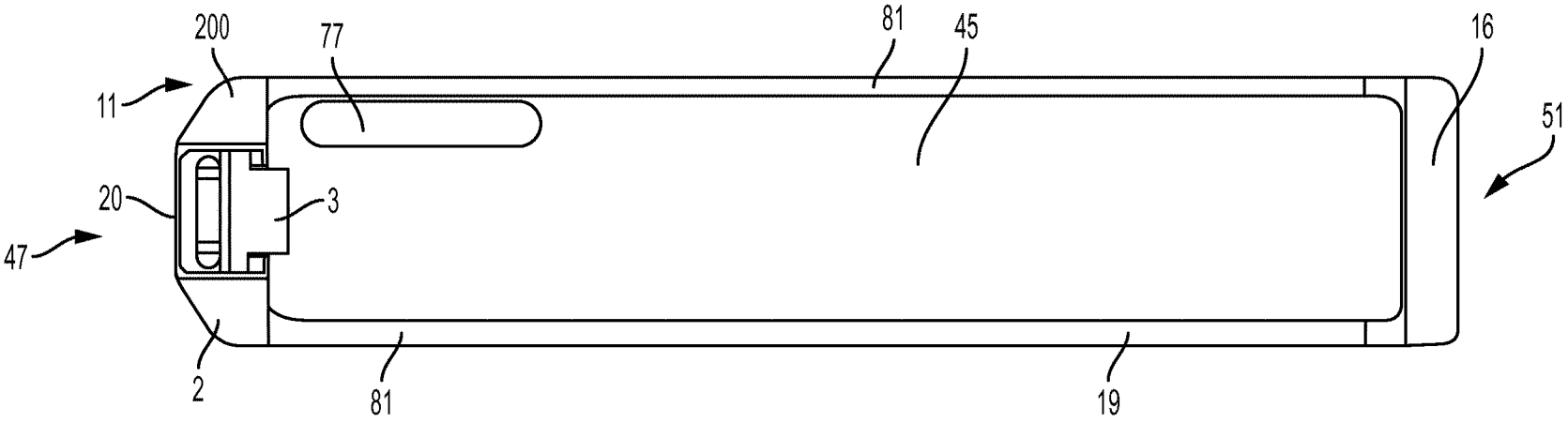
FIG. 16A is a top view of a different embodiment of the shell carrier holder.
Figure 16B:
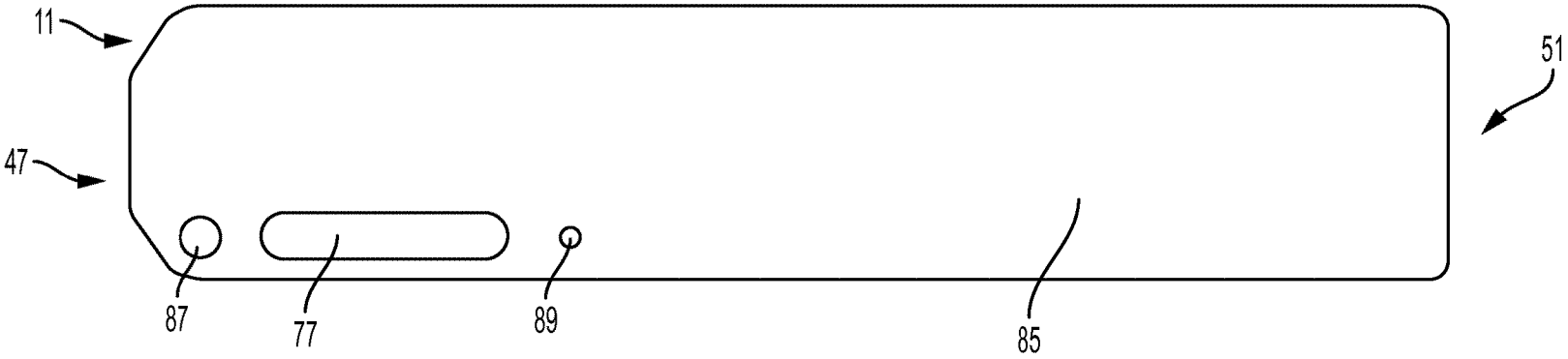
FIG. 16B is a bottom view of the shell carrier holder of FIG. 16A.

FIG. 15A is a top view of the embodiment of FIGS. 14A-14C. As in previous embodiments, the top of the carrier 10 may have openings 43 through which to view ammunition, such as, but not limited to, shells 14. In one aspect the upper lip 18 may be ridged, similar to the face 69 described above. FIG. 15B is a bottom view of the bottom surface 93 of the carrier 10. FIGS. 16A and 16B illustrate a top and bottom view, respectively, of the carrier holder 11. Carrier holder 11 comprises a latch assembly 7 which comprises three surfaces 2, 20, and 200, each of which comprise stop portion 9. In this embodiment, walls 2, 200 can be sloped inwardly toward the latch 3. Each of the surfaces 2, 20, 200 substantially surrounds latch 3. The carrier holder 11 also comprises an opening 77 that is positioned within the carrier holder 11 in the receiving surface 45. As shown in FIG. 16B, the carrier holder 11 can also comprise openings 87 and 89, defined on either side of opening 77.

Figure 17A:
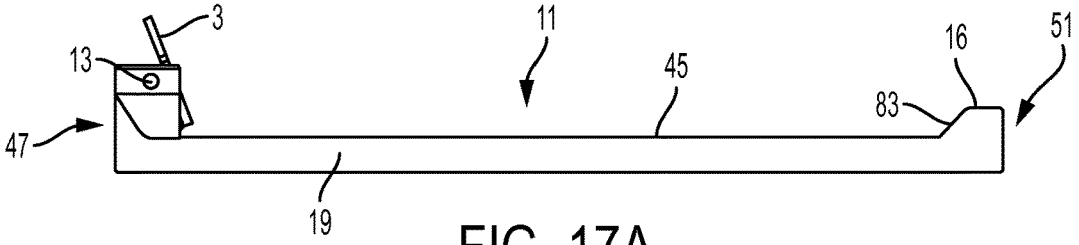
FIG. 17A is a side view of the shell carrier holder of FIG. 16A.
Figure 17B:
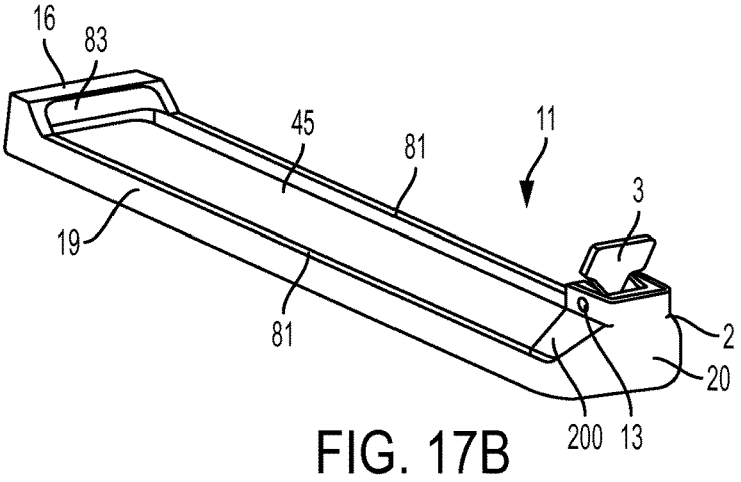
FIG. 17B is a front view of the shell carrier holder of FIG. 16A.
Figure 17C:
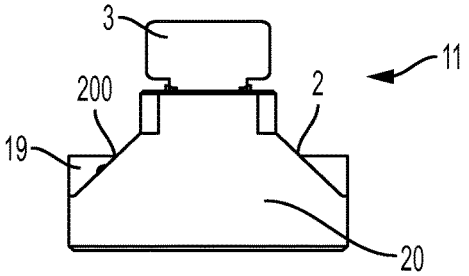
FIG. 17C is a front view of the shell carrier holder of FIG. 16A.
Figure 18A:
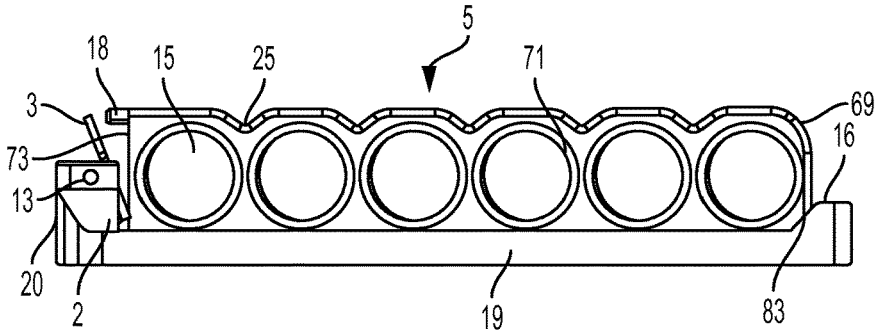
FIG. 18A is a side view of the shell carrier assembly, incorporating the components of FIGS. 14A-17C.
Figure 18B:
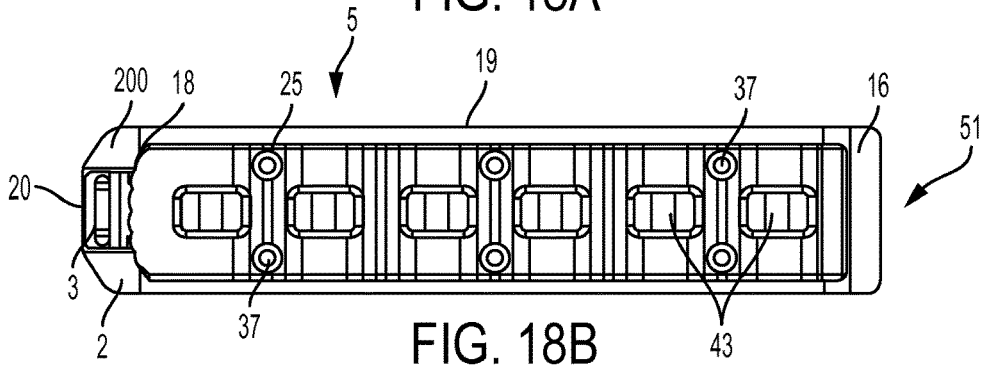
FIG. 18B is a top view of the shell carrier assembly of FIG. 18A.
Figure 18C:
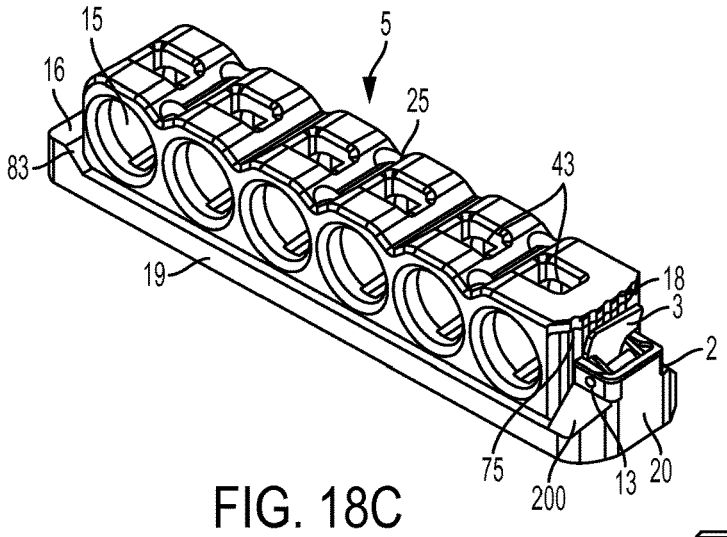
FIG. 18C is a perspective view of the shell carrier assembly of FIG. 18A.
Figure 18D:
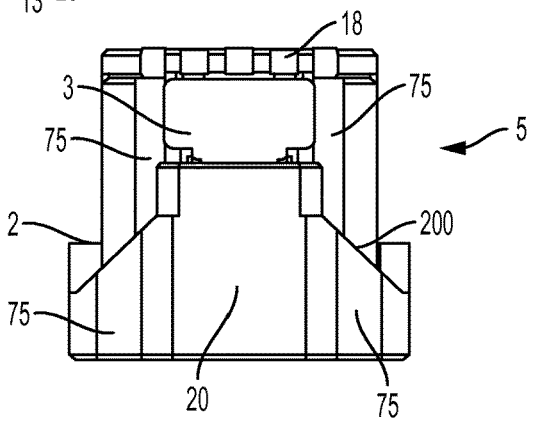
FIG. 18D is a back view of the shell carrier assembly of FIG. 14A.

FIGS. 17A through 17C illustrate the modified embodiment of the carrier holder of FIGS. 16A and 16B. The lip 16 may comprise a sloped portion 83, under which a groove can be defined by the lip 16 and the covered portion 83. The sloped portion 83 may be at least partially sloped.

FIGS. 18A through 18D illustrate various views of the carrier 10 of FIGS. 14A through 14C and the carrier holder 11 of FIGS. 17A through 17C.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

The above disclosure is intended to be illustrative and not exhaustive. This description will suggest many modifications, variations, and alternatives may be made by ordinary skill in this art without departing from the scope of the invention. Those familiar with the art may recognize other equivalents to the specific embodiments described herein. Accordingly, the scope of the invention is not limited to the foregoing specification.

What is claimed is:

1. A shell carrier assembly comprising: a proximal end and a distal end; a shell carrier; and a shell carrier holder, wherein the shell carrier holder comprises a releasable connector assembly; and wherein at least a portion of the shell carrier holder and at least a portion of the shell carrier are operably coupled by the releasable connector assembly, wherein the releasable connector assembly comprises a pin, a latch, a stop portion, and a spring, wherein the latch, stop portion, and spring each have a through-hole, and wherein the latch, the stop portion, and the spring are aligned to receive the pin.

2. The assembly of claim 1, wherein the releasable connector assembly is configured to be actuated from a biased position when the carrier assembly is in the assembled state, to an unbiased position in the unassembled state, thereby allowing the separation of the carrier from the carrier holder.

3. The assembly of claim 1, wherein the carrier comprises at least one retention piece.

4. The assembly of claim 1, wherein the carrier comprises at least one opening, wherein each opening is adjustably sized to receive at least one shell.

5. The assembly of claim 1, wherein the carrier comprises between one and six openings, and wherein the openings are configured to receive at least one shell.

6. The assembly of claim 1, wherein the shell carrier assembly is configured to be attached to at least a portion of a firearm device.

7. The assembly of claim 1, wherein the carrier comprises a first surface, the holder comprises a second surface, and in the assembled state the first surface is positioned in a contacting relationship with the second surface of the holder.

8. The assembly of claim 1, wherein the latch is a moveable, rotatable component.

9. The assembly of claim 1, wherein the releasable connector assembly is capable of being actuated between a first state in which the carrier and assembly are in a contacting relationship, and a second state in which the carrier and the assembly are disassembled.

10. The assembly of claim 1, wherein the carrier comprises a plurality of openings positioned in the top of the carrier for viewing at least a portion of at least one shell.

11. The assembly of claim 1, wherein the carrier comprises a proximal lip, wherein the proximal lip is configured to be a gripping piece.

12. The assembly of claim 1, wherein the releasable connector assembly is positioned at the proximal end of the carrier holder.

13. The assembly of claim 1, wherein the carrier holder is configured to receive the carrier in a tongue and groove fit.

14. The assembly of claim 1, wherein the carrier comprises at least one lip positioned at the distal end of the carrier, wherein the lip is configured to be received by at least one groove of the carrier holder.

15. The assembly of claim 1, wherein the carrier holder further comprises raised edges, a distal lip, and a receiving surface.

16. The assembly of claim 1, wherein the carrier comprises a housing, back plate, and at least one retention piece, wherein the housing, back plate, and the at least one retention piece are secured together using at least one screw.

17. The assembly of claim 3, wherein the retention piece comprises at least one of a retention spring, a coiled spring, a ball bearing, and a bumper.

18. The assembly of claim 16, wherein the carrier and the back plate comprise a plurality of openings, wherein each opening is paired with another opening.

* * * * *